United States Patent [19]

Fontana

[11] Patent Number: 4,625,508

[45] Date of Patent: Dec. 2, 1986

[54] HINGED BRACELET OF WATCH CHAIN TYPE

[75] Inventor: Fernando Fontana, Sesto Calende, Italy

[73] Assignee: Omega SA, Bienne, Switzerland

[21] Appl. No.: 710,804

[22] Filed: Mar. 12, 1985

[30] Foreign Application Priority Data

Mar. 20, 1984 [IT] Italy ..... 20156 A/84

[51] Int. Cl.[4] ..... F16G 13/00

[52] U.S. Cl. ..... 59/80; 59/82; 59/85; 59/90; 63/4

[58] Field of Search ..... 59/78, 80, 82, 85, 90, 59/91, 13, 35.1, 3; 63/3, 4, 9, 10; D11/22

[56] References Cited

U.S. PATENT DOCUMENTS

D. 157,244 2/1950 Dieterich ..... D11/22

D. 172,332 6/1954 Boots ..... D11/22

FOREIGN PATENT DOCUMENTS 2405100 5/1979 France ..... 59/85

OTHER PUBLICATIONS

"Nouvelle Orientation d'Omega fait ses Preuves," Journal du Jura, 5/25/84.

*Primary Examiner*—Francis S. Husar

*Assistant Examiner*—David B. Jones

*Attorney, Agent, or Firm*—Griffin, Branigan, & Butler

[57] ABSTRACT

A bracelet comprises a plurality of interengaging pivotally-connected flat links. Each link has an elliptical contour and a central diamond-shaped opening, a first channel in the upper face and a second channel in the lower face, the channels crossing each other so that the sides of the channels coincide with the pairs of opposed edges of the opening. One end of the first channel has a slot extending from the edge to the opening for the passage of another link during assembly. This other link is turned through 90° to lie in the same plane after passing through the slot and the links are pivotally connected by pivot pins which pass through apexes of the diamond-shaped opening lying on the center line of the bracelet and are received in holes extending within the thickness of the links.

8 Claims, 4 Drawing Figures

HINGED BRACELET OF WATCH CHAIN TYPE

BACKGROUND OF THE INVENTION

The present invention relates to a bracelet in particular from a wristwatch, comprising a plurality of links of flattened form, of the watch chain type.

Metal bracelets are most frequently to be found in the form of an assembly of flat links which are disposed in side-by-side relationship and which are hingedly connected to each other in succession. The links generally comprise small plates which are disposed parallel to each other and which are connected to each other by means of pins forming hinges, which are disposed perpendicularly to the longitudinal direction of the bracelet. That kind of construction makes it possible, if desired, to provide a bracelet of decreasing width, thereby affording a pleasant configuration, by joining together links whose width itself decreases. Such a construction also provides a high degree of flexibility at the same time as virtually eliminating any lateral displacement of one link with respect to the adjacent link. However, that kind of bracelet is particularly monotonous in appearance, as is occasioned in particular by the repetition of links which have a flat surface.

In order to give the bracelet a more aesthetically attractive appearance, while still proposing using links which have a flat surface, it is possible to use a bracelet of watch chain type. Such a bracelet is formed by intertwined links which are more or less close-fitting, being a construction as is employed for the chains for pocket watches. In that case, the rings forming the links of the chain, each of which lies over another, impart a wavy line to the bracelet, which is a very attractive effect. However, the watch-type chain suffers from the disadvantages that the rings which make up the chain must be welded or soldered once they have been fitted into each other, which is not an easy matter when using certain materials such as titanium which are difficult to weld or solder but which, besides their lightness, also afford a remarkable degree of resistance to wear. It should also be noted that the conventional watch-type chain has rings which move laterally with respect to each other, the effect of which is to permit the chain to be rolled around itself in its longitudinal direction. That is an undesirable effect, in regard to a watch bracelet.

SUMMARY OF THE INVENTION

The aim of the present invention is to propose a bracelet having the appearance of a watch-type chain without suffering from the above-mentioned disadvantages. For that purpose it comprises a plurality of interengaging flat links, each of said links being of generally elliptical contour with the major axis of the ellipse extending longitudinally of the bracelet, a central diamond-shaped opening in each link whose main diagonal coincides with the major axis of the ellipse, a first channel extending obliquely to the said major axis from one edge of the link to the other in the upper surface of each link, the edges of said first channel extending along a first pair of opposite sides of said opening, a second channel extending obliquely to said major axis from one edge of the link to the other in the under surface of each link, the edges of said second channel extending along the second pair of opposite edges of said opening, a slot in each link extending along said first channel between one edge of the link and the said opening, said slot permitting the passage of a second link when the bracelet is assembled, and means for mutual pivotal connection between each pair of adjacent links in said chain about transverse axes lying in the plane of said links.

DETAILED DESCRIPTION OF THE INVENTION

Figure 1B:
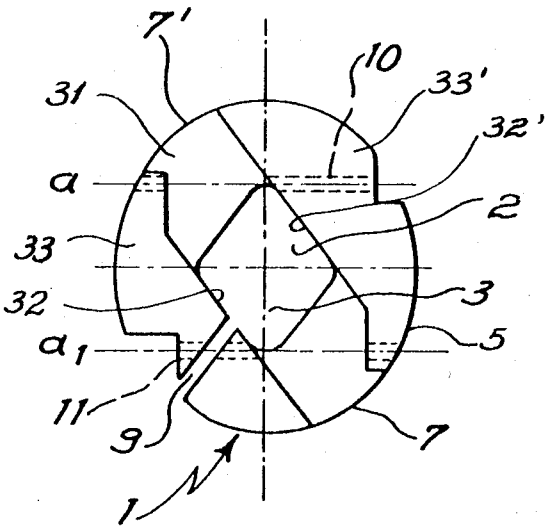
FIGS. 1*a* and 1*b* show a view from above and a view from below respectively of a link of the bracelet according to the invention.
Figure 1A:
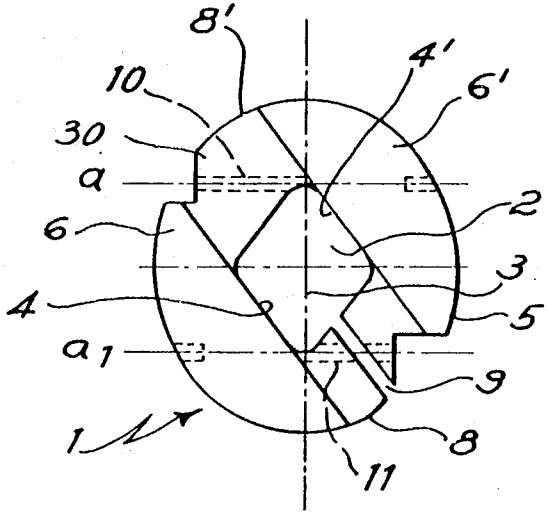

The link 1 shown in FIG. 1*a* is of an elliptical configuration as indicated at 5, the major axis 3 of the ellipse extending in the longitudinal direction of the bracelet. Provided at the centre of the link 1 is a diamond-shaped opening 2 whose main diagonal coincides with the major axis 3 of the ellipse. A first channel 30 which extends obliquely from one edge 8 of the link to the other edge 8' of the link is hollowed out in the thickness of the link, in the side providing its upper face. The edges of the channel 30 go along the two first oppositely disposed sides 4 and 4' of the diamond-shaped opening 2. Thus, when seen from above, the link 1 has two raised projecting portions 6 and 6' which are separated by the channel 30. The portions 6 and 6' may have a flat top surface but, in a preferred embodiment of the invention, they have a rounded or ellipsoidal dome-like configuration. A slot 9 is provided in the thickness of the link and extends along the channel 30 between the diamond-shaped opening 2 and the edge 8 of the link. A second link can be introduced into the first link, by way of the slot 9.

FIG. 1*b* shows the same link 1 seen from below and turned around through 180° with respect to the view shown in FIG. 1*a*. In this case, a second channel 31 which extends obliquely from one edge 7 of the link to the other edge 7' thereof is hollowed out in the thickness of the link, on the side providing its underneath face. The edges of the channel 31 go along the two second oppositely disposed sides 32 and 32' of the diamond-shaped opening 2. When seen from below, the link 1 also has two raised portions 33 and 33' which are separated by the channel 31. The portions 33 and 33' preferably have a flat projecting surface.

In the arrangement just described above, it will be appreciated that, if, by way of its edge, a second link is introduced into a first link by way of the slot 9, and that the second link is then turned through 90° with respect to the first link, the portion of the channel 30 which is disposed towards the edge 8 of the first link will move into a position of overlap in the portion of the channel 31 which is disposed towards the edge 7' of the second link at the same time as the portion of the channel 31 which is towards the edge 7 of the first link will overlap in the portion of the channel 30 towards the edge 8' of the second link. In other words, and as seen from above, the raised portion 6' of the second link will cover the portion of the channel 30 which is disposed towards the edge 8 of the first link, while the raised portion 6 of the first link will cover the portion of the channel 30 which is disposed towards the edge 8' of the second link. That therefore provides for intertwining of two links and so on, when a third link is fitted into the second link, etc.

It remains for the links making up the bracelet to be provided with means permitting reciprocal pivotal movement thereof, without which means the links would not remain in a flat condition and would tend to roll up one after the other. For that purpose, and in accordance with a preferred construction of the present invention, provided in the link are two holes 10 and 11 which pass through the link from one side to the other, by way of the edge thereof, as can be seen from FIGS. 1*a* and 1*b*. The holes 10 and 11 are formed along the axes a and $a_1$ respectively. The first and second holes 10 and 11 pass respectively through the first and second apexes of the diamond-shaped opening 2, through which the main diagonal 3 passes, said holes being perpendicular to the diagonal 3. When two links are disposed in succession, the axis $a_1$ of the first link coincides with the axis a of the second, which permits a pivot-forming pin to be introduced into the respective holes which are thus aligned with each other.

Steps are taken to impart to each of the portions of the channel 30, a double slope meeting at a ridge portion emerging from the floor of the channel and extending parallel to the axes a and $a_1$ respectively.

In regard to the channel 31, it has an arched or cambered floor, the curvature of which is similar to that afforded by the immediately upper face 6, 6' of the link, so that at that location the link is of a reduced thickness which is also intended to pass through the slot 9 of another link when the bracelet is being assembled. The link will therefore have a slot 9 which is slightly wider than the above-mentioned reduced thickness.

The channel 30 of a first link co-operates with the channel 31 of a second link and the respective configuration of each of those channels, as just described above, thus ensures angular mobility of one link with respect to the other when they are fitted together. It will be appreciated that the angle of operative movement of one link on another is that of the angle defined by the double slope configuration at the floor of the channel 30.

Figure 2:
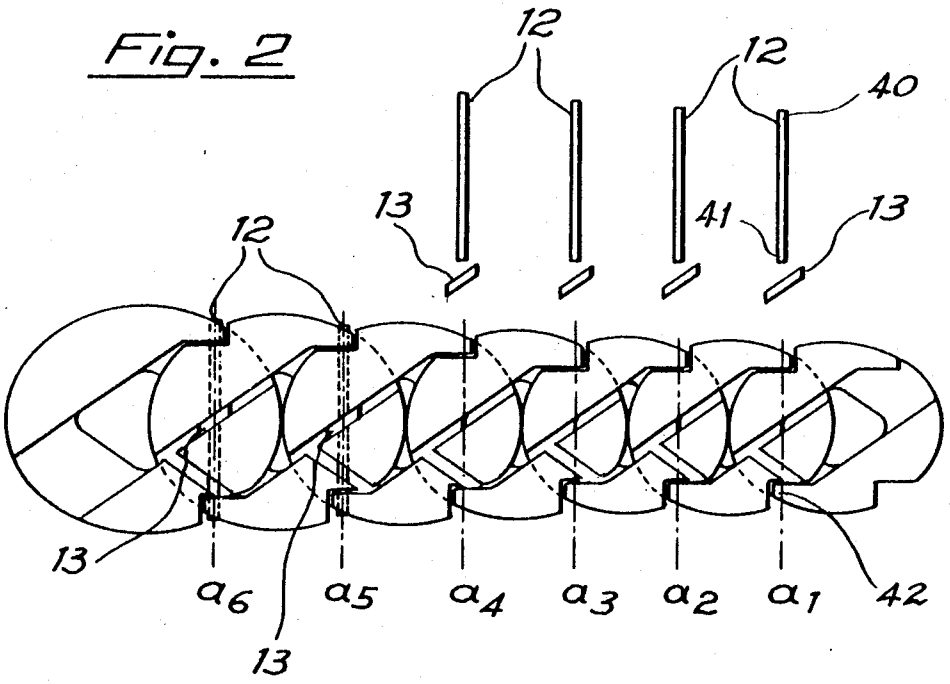
FIG. 2 shows a view from below of a segment of bracelet in the partially assembled condition.

FIG. 2 is a view from below of a partially assembled segment of bracelet. The first four links at the right-hand side have been brought into overlapping engagement with each other. The pins 12 have not yet been fitted into the holes whose axes are denoted by $a_1$ to $a_4$. In order to minimize lateral displacement, the drawing shows spacer members 13 in a non-assembled position. The three links on the left-hand side are shown after fitting of the pins 12 and the spacer members 13 which are disposed on the line along which the pins 12 extend, and between two links.

It should be noted that the pins 12 may be fitted into their respective holes. That will be the case in particular in regard to the links which will not have to be removed, for example those which are disposed at the watch end. At the catch end of the bracelet however, it is desirable to be able to shorten or lengthen the bracelet by removing or adding a link respectively. In such a case, at its end 40, the pin 12 will have a slot forming a screw head while at its end 41 it will have a screw thread which will be screwed into a screwthreaded hole 42 provided in the end of the hole in the last link, the axis of which is denoted by $a_1$.

Figure 3:
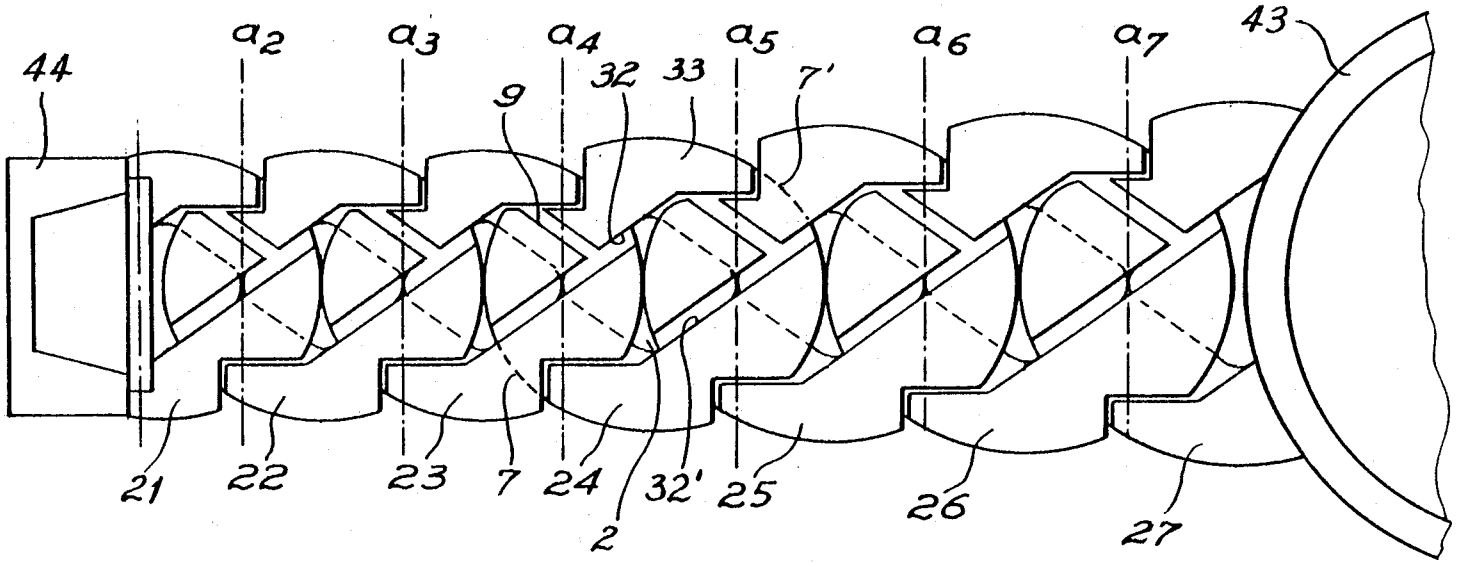
FIG. 3 shows a view from below of half a bracelet to which a watch is attached at one end, with a closure device at the other end.

FIG. 3 is a view on a larger scale of half a bracelet as seen from below. A watch which is diagrammatically indicated by its casing portion 43 is attached to the bracelet half at one end thereof, while a catch or clasp device having a loop member 44 is attached to the bracelet half at the other end. Welded or soldered to the portion 43 is the first link 27 (which could also be mounted pivotably). The catch loop member 44 is pivotally connected to the first link 21. FIG. 3 also shows that the first three links 21, 22 and 23 are identical while the last three links 24, 25 and 26 increase in surface area. Each of the links shown is similar to that described with reference to FIG. 1*b*, the link 24 bearing the same references as those used in FIG. 1*b*.

If the bracelet shown in FIG. 3 is intended for a wristwatch, it is clear that it could be used for other purposes, in particular for items of jewellery such as necklaces or ornamental bracelets or bangles. In the case of a necklace however, the endeavour will be to produce not a straight line, as in the case of a wristwatch, but a curved line. That effect may be achieved by providing holes extending along axes $a_2$, $a_3$ etc. which are convergent relative to each other, instead of being parallel as shown in FIG. 3.

Thus, as will be seen from the foregoing description, it is possible to construct bracelets of the watch chain type having flat links in which the link rings are not welded or soldered but which have a high degree of pivotability while remaining in one plane without suffering from lateral displacement. That therefore provides a watch-type chain which does not have the disadvantage of twisting around itself. That construction also makes it possible to reduce or increase the length of the chain without having to cut or solder rings. The rounded or ellipsoidal shape which can be imparted to the top surface of the rings also increases the resemblance between the bracelet according to the invention and a conventional watch-type chain. It will also be noted that the above-described construction enjoys a much higher degree of safety than that afforded by a conventional bracelet. In fact, if one of the pins 12 should break, the links will not be able easily to become detached because, in order to separate two links, it is necessary for the edge of one link to be passed through the slot of the adjacent link, and that can only be done by paying particular attention to such a mode of operation.

To close, it will be stated that the links may be made of any kinds of material: metal which may or may not be a precious metal, a metal which may or may not be suitable for welding or soldering, or a non-metal material such as carbon fibre or plastics material. In the last-mentioned cases, it will be possible to mould the link in a single operation.

What I claim is:

1. A bracelet comprising a plurality of inter-engaging flat links (1) having an upper surface and an under surface, each of said links being of generally elliptical contour (5) with the major axis (3) of the ellipse extending longitudinally of the bracelet, a central diamond-shaped opening (2) in each link whose main diagonal coincides with the major axis of the ellipse, a first channel (30) extending obliquely to the said major axis diagonally from one edge (8) of the link to the other (8') in the upper surface of each link, the edges of said first channel extending along a first pair of parallel opposite sides (4,4') of said diamond-shaped opening, a second channel (31) extending obliquely to said major axis diagonally from one edge (7) of the link to the other (7') in the under surface of each link, the edges of said second channel extending along a second pair of parallel opposite edges (32,32') of said diamond-shaped opening, a slot (9) in each link extending along said first channel between one edge of the link and said opening (2), said slot permitting the passage of a second link when the bracelet is assembled, and means (10,11,12) for mutual pivotal connection between each pair of adjacent links in said chain about transverse axes lying in the plane of said links.

2. A bracelet comprising a plurality of inter-engaging flat links (1) having an upper surface and an under surface, each of said links being of generally elliptical contour (5) with the major axis (3) of the ellipse extending longitudinally of the bracelet, a central diamond-shaped opening (2) in each link whose main diagonal coincides with the major axis of the ellipse, a first channel (30) extending obliquely to the said major axis from one edge (8) of the link to the other (8') in the upper surface of each link, the edges of said first channel extending along a first pair of opposite sides (4,4') of said opening, a second channel (31) extending obliquely to said major axis from one edge (7) of the link to the other (7') in the under surface of each link, the edges of said second channel extending along a second pair of opposite edges (32,32') of said opening, a slot (9) in each link extending along said first channel between one edge of the link and said opening (2), said slot permitting the passage of a second link when the bracelet is assembled, and means (10,11,12) for mutual pivotal connection between each pair of adjacent links in said chain about transverse axes lying in the plane of said links, said pivotal connection means comprised of first and second holes (10,11) extending through each of said links from one edge to the other within the thickness of the link and passing respectively through first and second apexes of the diamond-shaped opening which lie on the main diagonal thereof and further comprised of pivot pins (12) each passing through a first hole of one link and a second hole of an adjacent link to interconnect said links.

3. A bracelet as claimed in claim 2 in which the holes for said pivot pins are perpendicular to said main diagonal.

4. A bracelet as claimed in claim 2 in which said pivot pins are fitted pins.

5. A bracelet as claimed in claim 2 in which at least one of said pivot pins is a threaded pin which is in threaded engagement with one of the holes to allow removal of the pin and separation of a link from the bracelet.

6. A bracelet as claimed in claim 2 in which a spacer member is disposed between a pair of links on the line of the pivot pin to reduce lateral displacement of the links.

7. A bracelet as claimed in claim 2 in which the periphery of each link is notched at the ends of the first channel and has corresponding raised portions at the ends of the second channel, the pivot pin holes each extending from a notch through the link into the second channel and continuing from the second channel through one of said raised portions.

8. A bracelet as claimed in claim 1 in which the upper face of each link is of domed ellipsoidal shape.

* * * * *